US010934819B2

(12) United States Patent
Khachaturov

(10) Patent No.: US 10,934,819 B2
(45) Date of Patent: Mar. 2, 2021

(54) LINEAR ELECTRIC SUBMERSIBLE PUMP UNIT

(71) Applicant: Dmytro Khachaturov, Kharkov (UA)

(72) Inventor: Dmytro Khachaturov, Kharkov (UA)

( * ) Notice: Subject to any disclaimer, the term of this patent is extended or adjusted under 35 U.S.C. 154(b) by 224 days.

(21) Appl. No.: 16/051,959

(22) Filed: Aug. 1, 2018

(65) Prior Publication Data

US 2019/0153831 A1 May 23, 2019

(30) Foreign Application Priority Data

| | | |
|---|---|---|
| Nov. 20, 2017 | (UA) | a 2017 11361 |
| Nov. 29, 2017 | (UA) | a 2017 11687 |
| Nov. 29, 2017 | (UA) | u 2017 11650 |
| Dec. 29, 2017 | (UA) | u 2017 13084 |
| Dec. 29, 2017 | (UA) | u 2017 13104 |
| Jan. 11, 2018 | (UA) | u 2018 00311 |
| Jan. 25, 2018 | (RU) | RU2018102964 |
| Jan. 31, 2018 | (RU) | RU2018103638 |
| Feb. 9, 2018 | (RU) | RU2018104953 |

(Continued)

(51) Int. Cl.
*E21B 43/12* (2006.01)
*F04B 47/06* (2006.01)

(Continued)

(52) U.S. Cl.
CPC ..... *E21B 43/128* (2013.01); *E21B 43/38* (2013.01); *E21B 47/008* (2020.05); *E21B 47/12* (2013.01);

(Continued)

(58) Field of Classification Search
CPC ..... F04B 47/06; F04B 17/03; F04B 47/12; E21B 43/128; E21B 47/008; E21B 43/38; H02K 5/132; H02K 41/031
See application file for complete search history.

(56) References Cited

U.S. PATENT DOCUMENTS 3,548,273 A * 12/1970 Vallauri ..... H02K 41/03 318/135
4,815,949 A * 3/1989 Rabson ..... F04B 47/06 310/14

(Continued)

*Primary Examiner* — Patrick Hamo
(74) *Attorney, Agent, or Firm* — Nadya Reingand; Yan Hankin

(57) ABSTRACT

An invention relates to a field of oil production, in particular, to installations with displacement pumps driven by submersible linear electric motors, and can be used for production of stratum fluids from a marginal well stock from great depths. The described technical solution implementation ensures unification of a design with simultaneous increase in a manufacturing processability by means of involving of easily removable interoperable modules for its manufacture. Also a described embodiment contributes to decrease in a pump unit dimensions. According to the described embodiment of the invention a telemetry system performance provides an increase in a level of protection from a high-voltage interference with implementation of a hardware-software mode of a surface control unit for checking an insulation. Providing that an arrangement of the described design ensures a reduction in dynamic loads on elements of an electrical motor design and contributes to increase in its operating resource.

14 Claims, 10 Drawing Sheets

(30) Foreign Application Priority Data

| | | |
|---|---|---|
| Feb. 13, 2018 | (RU) | RU2018105379 |
| Feb. 21, 2018 | (RU) | RU2018104336 |
| Mar. 20, 2018 | (UA) | u 2018 02824 |
| Apr. 2, 2018 | (RU) | RU2018111715 |

(51) Int. Cl.

| | |
|---|---|
| ***F04B 47/12*** | (2006.01) |
| ***F04B 17/03*** | (2006.01) |
| ***E21B 43/38*** | (2006.01) |
| ***E21B 47/12*** | (2012.01) |
| ***E21B 47/008*** | (2012.01) |

(52) U.S. Cl.
CPC ..... *F04B 17/03* (2013.01); *F04B 47/06* (2013.01); *F04B 47/12* (2013.01)

(56) References Cited

U.S. PATENT DOCUMENTS

| | | | | |
|---|---|---|---|---|
| 5,960,875 | A * | 10/1999 | Beauquin | E21B 43/128 166/66.4 |
| 6,176,308 | B1 * | 1/2001 | Pearson | E21B 43/128 166/65.1 |
| 10,634,131 | B2 * | 4/2020 | Khachaturov | E21B 43/38 |
| 2013/0186638 | A1 * | 7/2013 | Filippov | H02K 33/16 166/372 |
| 2016/0102535 | A1 * | 4/2016 | Wang | F04B 19/22 417/417 |
| 2016/0105091 | A1 * | 4/2016 | Wang | H02K 41/02 310/12.18 |
| 2017/0184097 | A1 * | 6/2017 | Reeves | F04B 1/14 |
| 2018/0195373 | A1 * | 7/2018 | Bell | H02K 5/225 |

* cited by examiner

LINEAR ELECTRIC SUBMERSIBLE PUMP UNIT

CROSS-REFERENCES TO RELATED APPLICATIONS

The present patent application claims priority to Ukrainian patent application a201711361 filed Nov. 20, 2017, Ukrainian Utility Model application u201711650 filed Nov. 29, 2017 (currently issued as a patent No. 124038), Ukrainian patent application a201711687 filed Nov. 29, 2017, Ukrainian Utility Model application u201713084 filed Dec. 29, 2017, Ukrainian Utility Model application u201713104 filed Dec. 29, 2017, Ukrainian Utility Model application u201800311 filed Jan. 11, 2018, Ukrainian Utility Model application u201802824 filed Mar. 20, 2018, Russian patent application 2018102964 filed Jan. 25, 2018, Russian Utility Model application 2018103638 filed Jan. 31, 2018, Russian patent application 2018104953 filed Feb. 9, 2018, Russian Utility Model application 2018105379 filed Feb. 13, 2018, Russian Utility Model application 2018104336 filed Feb. 21, 2018, Russian patent application 2018111715 filed Apr. 2, 2018.

FIELD OF INVENTION

An invention relates to a field of oil production, in particular, to installations with displacement pumps driven by submersible linear electric motors, and can be used for production of stratum fluids from a marginal well stock from great depths.

BACKGROUND

A linear submersible motor with permanent magnets (hereinafter referred to as LSMPM) is used to actuate pump plungers in the said device. The known LSMPMs contain inductance coils forming a stationary part, namely a stator, as well as a movable part, namely a slider, formed by permanent magnets located in a stator bore. The specified slider is connected to the pump plungers and provides a reciprocal motion transmission. Changing a voltage polarity in a stator winding ensures a progressive motion of the slider in a longitudinal direction. The mentioned type of equipment has become widely used, mainly in small-diameter wells with a low production rate of less than 25 m3/day, and as a number of such wells increases every year, such installations are becoming progressively solicited. As a result, there are increasingly high requirements for manufacturability, maintainability and reliability of submersible pump units.

Most of currently known pump units include a plunger pump module of reciprocating action and a submersible linear electric motor connected to it by means of a threaded connection with telemetry units contained in a single enclosure, as well as a hydroprotection unit.

Claim for Invention US2015/0176574A1, F04B 47/00 dated 25, Jun. 2015 sets out a submersible wellbore pump, consisting of a static cylinder and a movable plunger, and a submersible motor, connected to the wellbore pump by means of a threaded or flanged connection. The specified motor is connected to a plunger of the submersible wellbore pump and is capable to perform a reciprocal motion of the plunger.

A disadvantage of this technical solution constitutes a relatively low reliability associated with a lack of telemetry and hydraulic compensator units.

Claim for Invention RU2549381 dated 27, Apr. 2015, Int. Cl. F04B 47/06, F04B 17/03, sets out a linear electric motor of a submersible pump unit, comprising a sealed stator containing cores with coils, a current lead and a head designed for connecting to a pump installed therein. A movable stock with a connecting rod, designed for connection to a pump plunger, and an active hermetically sealed slider, connected to the stock by means of a coupling joint, are placed into the stator. The slider contains successively mounted permanent magnets. The head is connected to a stator enclosure by a threaded connection performed through space plates with sealing elements. A compensator with an elastic diaphragm, performed as a bulb, having a middle portion diameter greater than a diameter of each of its end portions, is attached to a base of the stator in an analogical manner, while one end of the diaphragm is connected to the stator base and the other end is connected to a stub connecting the electric motor with the compensator.

Disadvantages of the described technical solution may include a lack of a telemetry unit and electric motor operation control elements, which can lead to an inefficient utilization.

Also, Claim for Invention RU2615775 dated 11, Apr. 2017, Int. Cl. F04B 47/06, F04B 17/03 sets out a borehole pump unit, installable into a wellbore, comprising a submersible part, including a plunger pump provided with pressure valves, and a gravity gas separator, above which a reversing valve unit is arranged, disposed in a single enclosure, comprising a coupling joint designed for fastening the borehole pump unit to the tubing string, as well as a submersible linear electric motor mounted under the plunger pump, comprising a static part in a form of a stator with a three-phase winding and temperature sensors installed, as well as a movable part located in a stator bore in a form of a slider configured to reciprocate with respect to the stator. A telemetry unit is arranged under the linear motor, comprising borehole fluid pressure and temperature sensors, a vibration sensor, an inclinometer and a measuring unit connected to temperature sensors installed in the linear motor and connected to a surface control unit via a zero point of wye-connected linear motor windings.

The described design is a production sample of the submersible pump unit, which is currently in operation, disadvantages of the described technical solution may include a single enclosure performing design, which can complicate its operation and reduce processability, as well as a maintainability.

The specified technical solution is determined to be the closest prior art. The claimed invention aims solving a technical problem constituting a creation of the linear electric submersible pump unit with high performance characteristics, increased reliability and maintainability, and also is executed with an ability to operate in wells of various diameters and productivities.

SUMMARY

A technical result achieved from the claimed technical solution implementation consists in unifying the design, reducing its dimensions, as well as increasing the manufacturing processability, which enables manufacturing of separate modules of the pumping unit, regardless of assembling stages completeness, and can lead to significant savings in working hours with a simultaneous increase in products output quantity. Also, a modularity of the design improves its performance characteristics significantly, in particular, the maintainability, allowing to replace faulty modules and resume a pumping unit operation promptly.

A claimed invention essence lies in the fact that the linear electric submersible pump unit is executed in the form of separately enclosed modules connected to each other by means of a detachable connection in order to form a single oil-filled system. This installation includes a linear electric motor module connected by a cable line to the surface control unit by means of a sealed plug and socket connection. The plug and socket connection is arranged beyond an input lead end on an extended electrical conductor. A hydraulic compensator module is installed at a base of the electric motor comprising an elastic diaphragm, an internal cavity of which is performed in fluid communication with a linear electric motor stator cavity by means of a connecting channel passing at attachment points of the elastic diaphragm. The said channel constitutes a part of an oil line, filling the linear electric submersible pump unit, comprising a cavity with wires of communication with the surface control unit. The wires are connected to a submersible module of the telemetric system with implemented hardware-software mode of the surface control unit for checking an insulation. While the hydraulic compensator module comprises a hydromechanical damper of the lowest end point of a moving part stroke of a linear drive, which constitutes an element of a damping system, that also contains a damper of the highest end point placed in a separate enclosure and installed between the linear electric motor module and the pump module.

According to a preferred embodiment of the invention of the linear electric submersible pump unit a detachable connection of the modules is made according to a flange connection approach, consisting of joinable modules and thread bushes mounted at flanks. Providing that one of the bushes comprises a flange and the second one constitutes a counterpart with pre-installed studs. The telemetric system module is equipped with a set of replaceable flanges with mounting holes, located depending on a diameter of an enclosure of the electric submersible pump unit, while a diameter of a mounting hole of the flange is performed constant and corresponds to a diameter of the module enclosure.

According to another preferred embodiment of the invention the telemetry system module comprises a filter switching device, containing a low frequency filter with a switching element of the control system, and is connected to the surface control unit, comprising a low frequency filter mounted on a line of communication with a secondary winding of a three-phase transformer and configured to protect the system from high voltage. Also the surface control unit contains a switching device configured to reverse a polarity of a voltage, fed into the line in order to measure the insulation resistance, and connected to a resistor of voltage removal proportional to a connection line current.

According to the preferred embodiment of the invention the elastic diaphragm of the hydraulic compensator module is hermetically fixed at the attachment points by means of a composite clamp and protected from mechanical damage by means of a non-metallic plug designed to limit deformations of the elastic diaphragm. While the elastic diaphragm of the hydraulic compensator module can be placed eccentrically with respect to a symmetry axis of the linear electric submersible pump unit.

According to the preferred embodiment of the invention the plug and socket connection is performed within overall dimensions of the pump unit enclosure, determined by its largest cross section, and includes the plug and socket connection arranged beyond the input lead end on the extended electrical conductor. The plug and socket connection consists of a hermetically sealed enclosure with at least one electrical conductor inserted inside and fixed by means of sealing polymer elements, while an exposed end of the extended conductor is mounted into the current lead end with a double sided seal by pressing crash elements. Also according to the mentioned embodiment the hermetically sealed plug and socket connection is arranged within an area embedded with respect to the surface and a diminishing socket, installed between a pump unit output and an oilwell tubing input.

Also the essence of the claimed invention consists in the fact that the damping system comprises at least one hydromechanical dynamic load compensating device installed in at least one of the end points of the movable part of the linear drive. The said device consists of a cylindrical chamber with drain ports filled with a working fluid and a movable hollow piston and reciprocating support member with a spring element installed therebetween. Wherein the said cylindrical chamber is configured to be filled with the working fluid from an ambient medium of the pumping unit.

The drain ports of the hydromechanical device in described damping system are spaced along a length of its cylindrical chamber and are designed to decelerate the stroke of the piston as they alternately covered with a piston body and as increase in resistance to a flow of the working fluid occurs.

Also according to the preferred embodiment of the damping system the hydromechanical device installed in at least one of the end points of the movable part stroke of the linear submersible electric motor is arranged to provide communication of the said movable part with a plunger of the pump module by means of a connecting element, installed in the piston cavity.

The mentioned moving part of the linear submersible motor is connected to the plunger of the pump unit by means of a connecting link consisting of a friction couple formed by a hollow enclosure element with a movable rod located inside. A diameter of the movable rod is equal to a diameter of the moving part of the linear submersible electric motor, wherein longitudinal dimensions and a stroke length of the movable rod are selected in such a way as to provide at least partial positioning of the movable part of the linear submersible electric motor within an enclosure element cavity of the friction couple. This thereby compensates radial loads on the movable part of the linear drive, ensuring an alignment and a sealing of the said movable part.

According to the described embodiment the movable part of the linear submersible electric motor consists of a plurality of permanent magnets separated by ferromagnetic inserts, namely magnetic field concentrators, between which copper alloy plugs are installed over the permanent magnets. These plugs provide a decrease in a friction ratio by means of transferring a part of a material onto an inner surface of a conductor pipe, as they wear out. Simultaneously the conductor pipe forms a friction couple with the moving part of the linear electric motor with a reduced friction ratio. Also according to the suggested embodiment, a hardness of the conductor pipe is higher than a hardness of the ferromagnetic inserts and the copper alloy plugs. The said conductor pipe is made of a non-magnetic material and its required hardness is achieved by means of a surface hardening.

BRIEF DESCRIPTION OF THE DRAWINGS

An essence of the claimed invention is explained, but is not limited to the following images:

DETAILED DESCRIPTION OF THE PREFERRED EMBODIMENT

Figure 1:
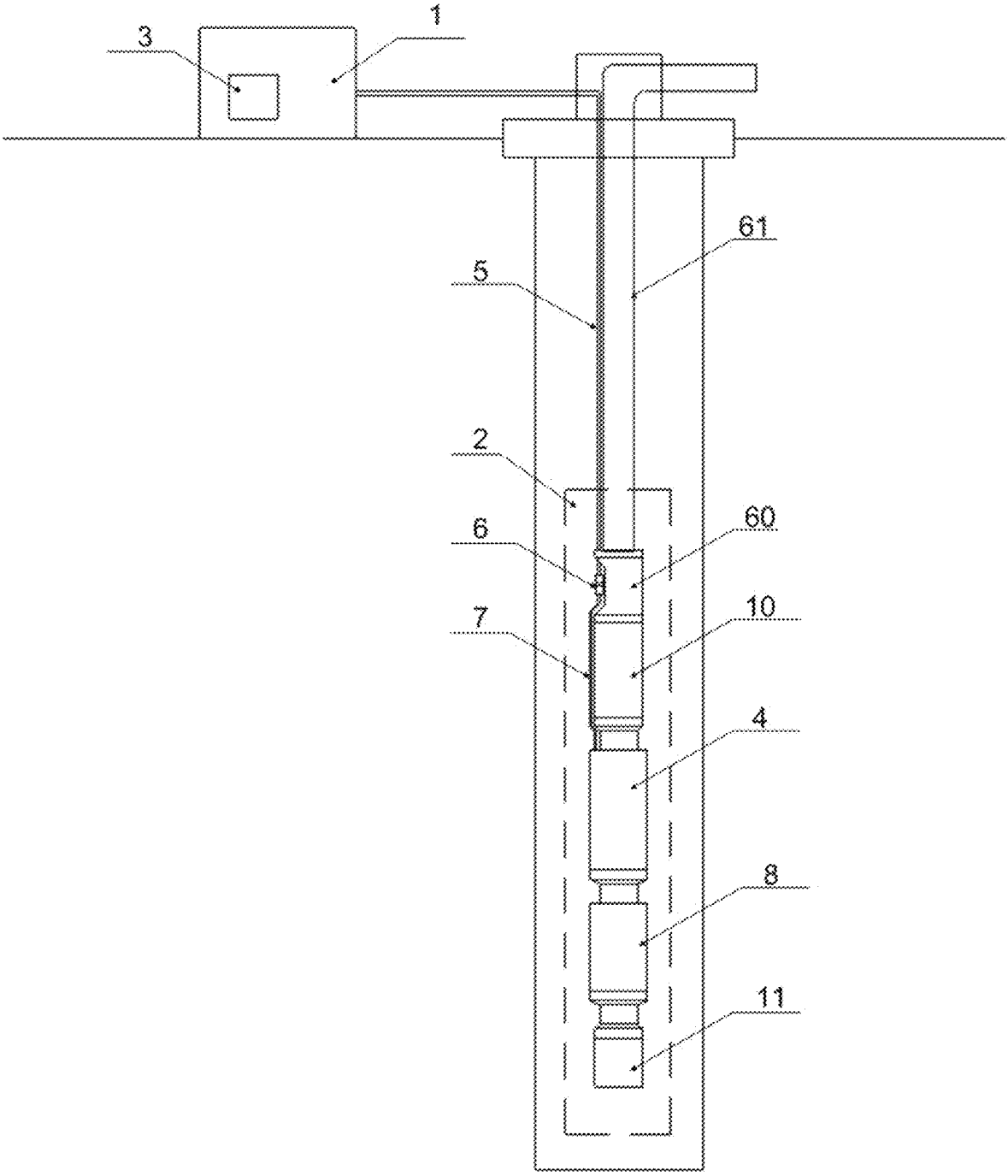
FIG. 1 shows a layout of the linear electric submersible pump unit.

The claimed linear electric submersible pump unit comprises surface 1 (FIG. 1) and submersible 2 parts. The surface part is represented in a form of surface control unit 3 performed as the three-phase high-frequency regulating inverter and the output transformer connected to linear submergible electric motor 4 by cable line 5 by means of sealed plug and socket connection 6, arranged beyond the input lead end on extended electrical conductor 7.

Submersible part 2 (FIG. 1, 2) is formed of linear electrical motor module 4 with permanent magnets, hydraulic compensator module 8, damping system 9. Said linear electrical motor 4 module is connected with pump module 10 and telemetry system submersible module 11. In the preferred embodiment the pump module 10 comprises a double acting plunger pump with integrated filters and the gravitational gas separation zone.

Submersible module 11 of the telemetry system is installed at the bottom portion of the pump unit and comprises a set of measuring sensors of well and motor parameters connected with the surface control unit via the zero point of the wye-connected linear motor windings.

Mentioned component parts are executed in the form of separately enclosed modules connected to each other by means of a detachable connection in order to form a single oil-filled system.

Figure 3:
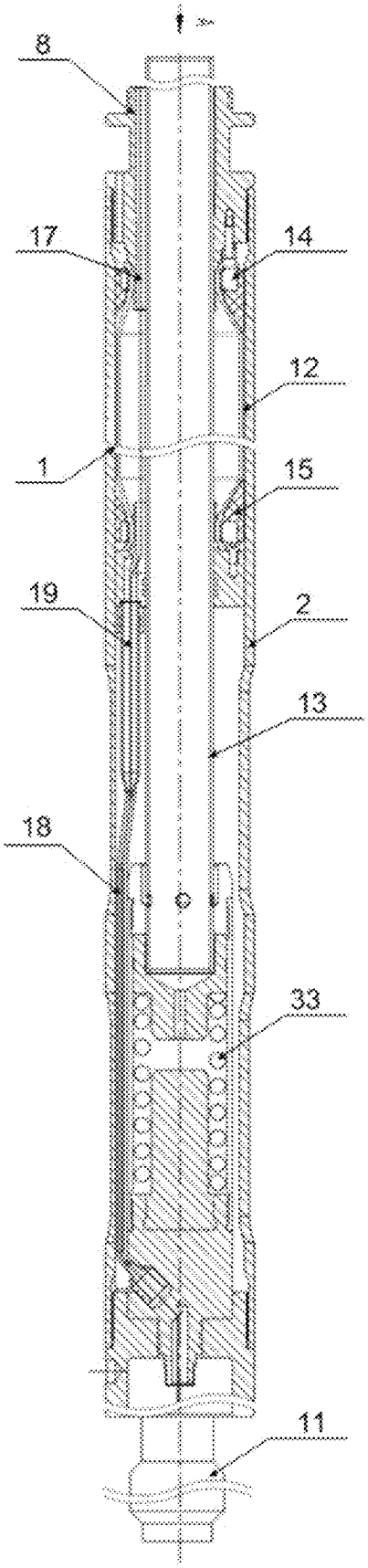
FIG. 3 shows the hydraulic compensator module.

Hydraulic compensator module 8 (FIG. 3) is installed at the base of the electric motor module 4 and comprises elastic diaphragm 12 with guide pipe 13 of the linear electric motor movable part arranged inside. Elastic diaphragm 12 is hermetically fixed at the attachment points by means of composite clamp 14 and is protected from mechanical damage by means of non-metallic plugs 15. Non-metallic plugs 15 are designed to limit deformations of the elastic diaphragm. Also, the elastic diaphragm of the hydraulic compensator module 8 can be placed eccentrically with respect to the symmetry axis of the linear electric submersible pump unit. The internal cavity of said diaphragm is placed in fluid communication with stator cavity 16 of linear electric motor module 4 by means of connecting channel 17 passing at the attachment points of the elastic diaphragm. The channel 17 constitutes a part of oil line 18, filling the linear electric submersible pump unit. Wires 19 for communication with the surface control unit are placed into the oil line cavity. The wires lead to submersible module 11 of the telemetry system or other electrical equipment installed at the bottom part of the linear electric motor.

Figure 4:
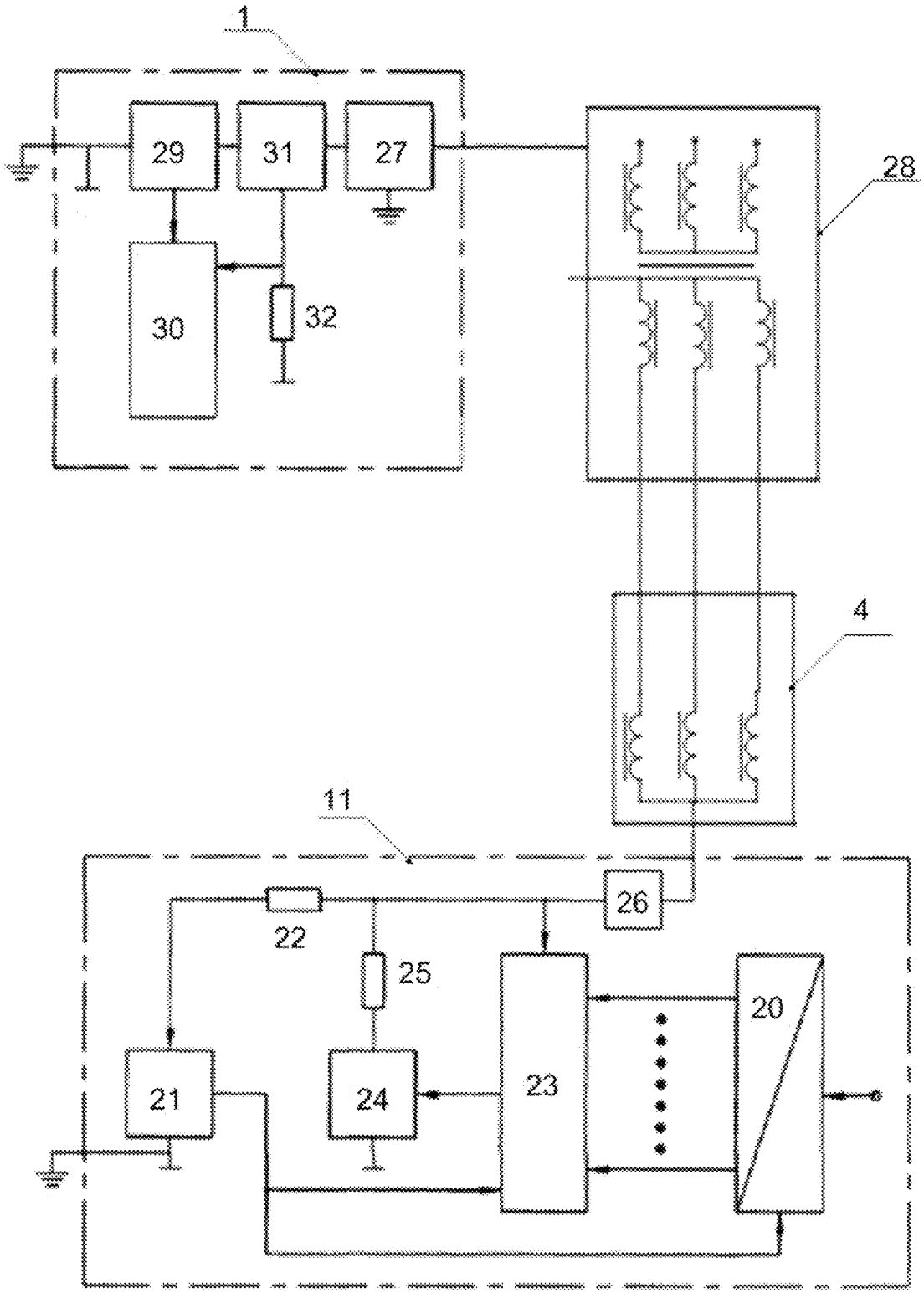
FIG. 4 shows a block diagram of the measuring telemetry system.

The applied telemetric system (FIG. 4) comprises an implemented hardware-software mode of the surface control unit for checking the insulation. The telemetry system submersible module 11 comprises a set of measuring sensors 20, voltage stabilizer 21, resistor 22, information collection and transmission device 23, electronic controlled key 24, connected to the electric motor windings via resistor 25 and filtering commutation device 26, the filtering commutation device 26 comprising the low frequency filter with the switching element of the control system. The telemetry system submersible module 11 is connected to surface control unit 3, comprising low frequency filter 27 mounted on the line of communication with the secondary winding of three-phase transformer 28 and configured to protect the system from high voltage. Also, the surface unit comprises power supply device 29 and information reception and processing device 30. Also, the surface control unit contains switching device 31 configured to reverse the polarity of the voltage, fed into the line in order to measure the insulation resistance, and connected to resistor 32 of voltage removal proportional to the connection line current.

Figure 5:
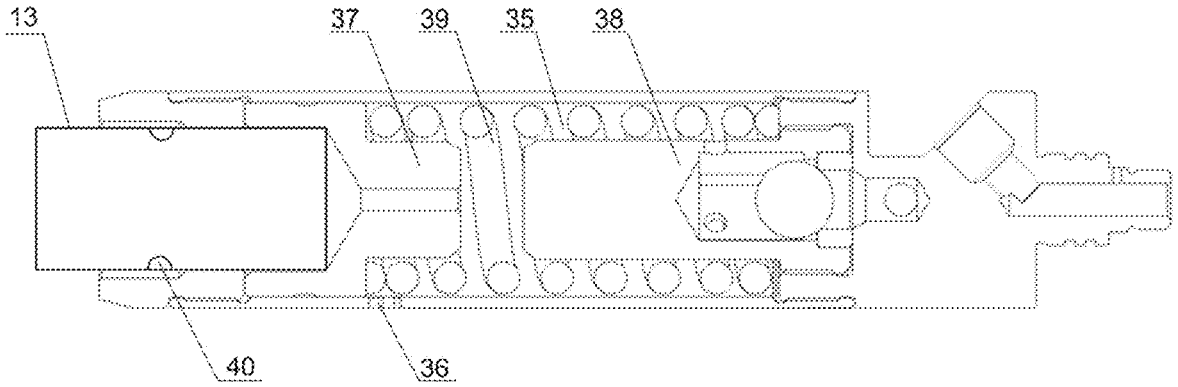
FIG. 5 shows first hydromechanical device of the first damper.

The damping system is integrated into the pump unit construction, as a result it is possible to enable its reliable and continuous operation. Hydraulic compensator module 8 comprises a first damper 33 (FIG. 3) with a first hydromechanical device of the lowest end point of the moving part stroke of the linear drive, which is represented on FIG. 5 in detail.

Figure 2:
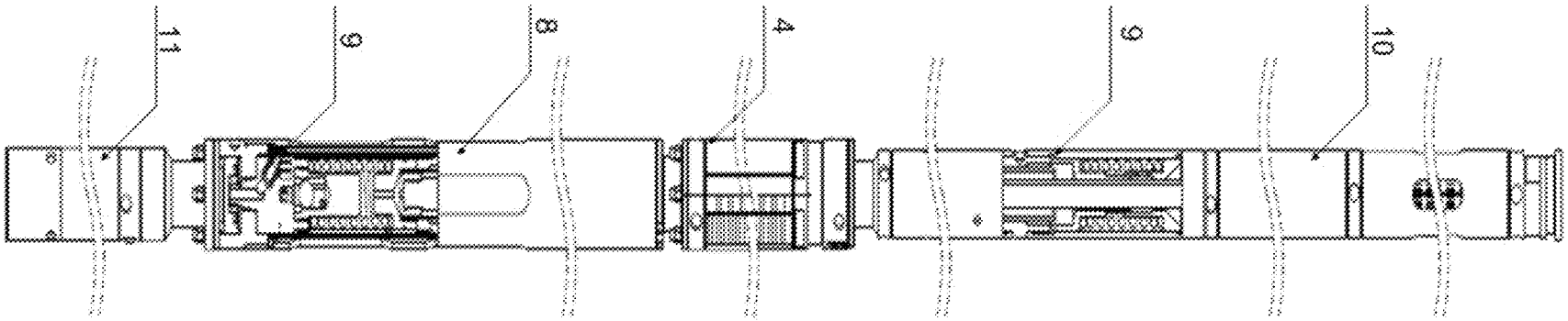
FIG. 2 shows a submersible part of the pump unit.
Figure 6:
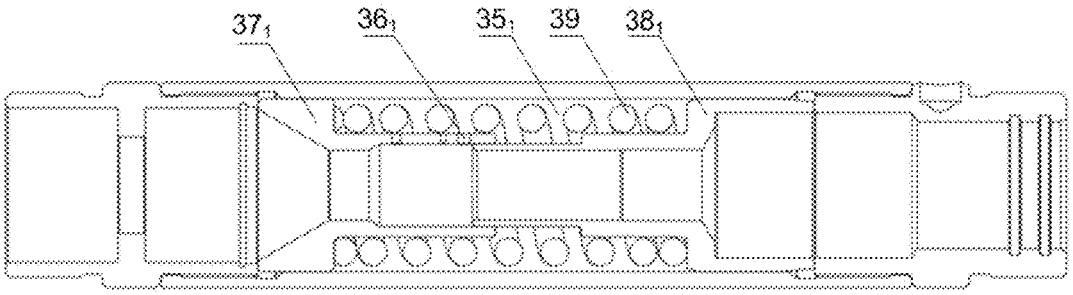
FIG. 6 shows second hydromechanical device of the second damper.

The specified first hydromechanical device constitutes an element of the damping system. The damping system also contains a second damper 34 (FIG. 6) with a second hydromechanical device of the highest end point placed in the separate enclosure and installed between linear electric motor module 4 and pump module 10 (FIG. 2).

The hydromechanical devices used in the design of the damping system comprise cylindrical chamber 35, $\mathbf{35}_1$ filled with the working fluid, drain ports 36, $\mathbf{36}_1$, a movable hollow piston 37, $\mathbf{37}_1$ with reciprocating support member 38, $\mathbf{38}_1$ and a spring element 39 installed therebetween. Said cylindrical chamber 35, $\mathbf{35}_1$ is configured for filling with the working fluid from the ambient medium of the linear electric submersible pumping unit.

Figure 13:
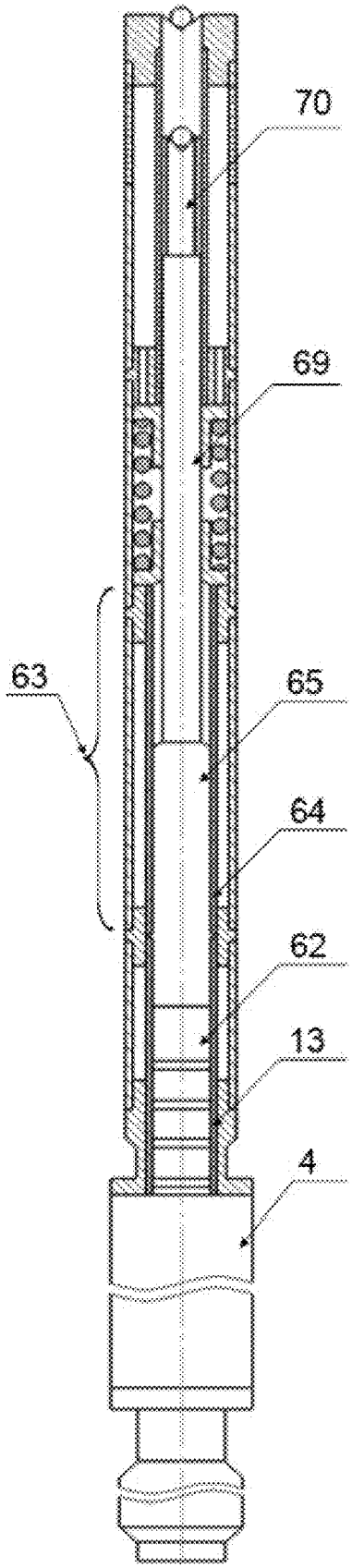
FIG. 13 shows the connecting link of the movable part of the linear submersible electric motor.
Figure 14:
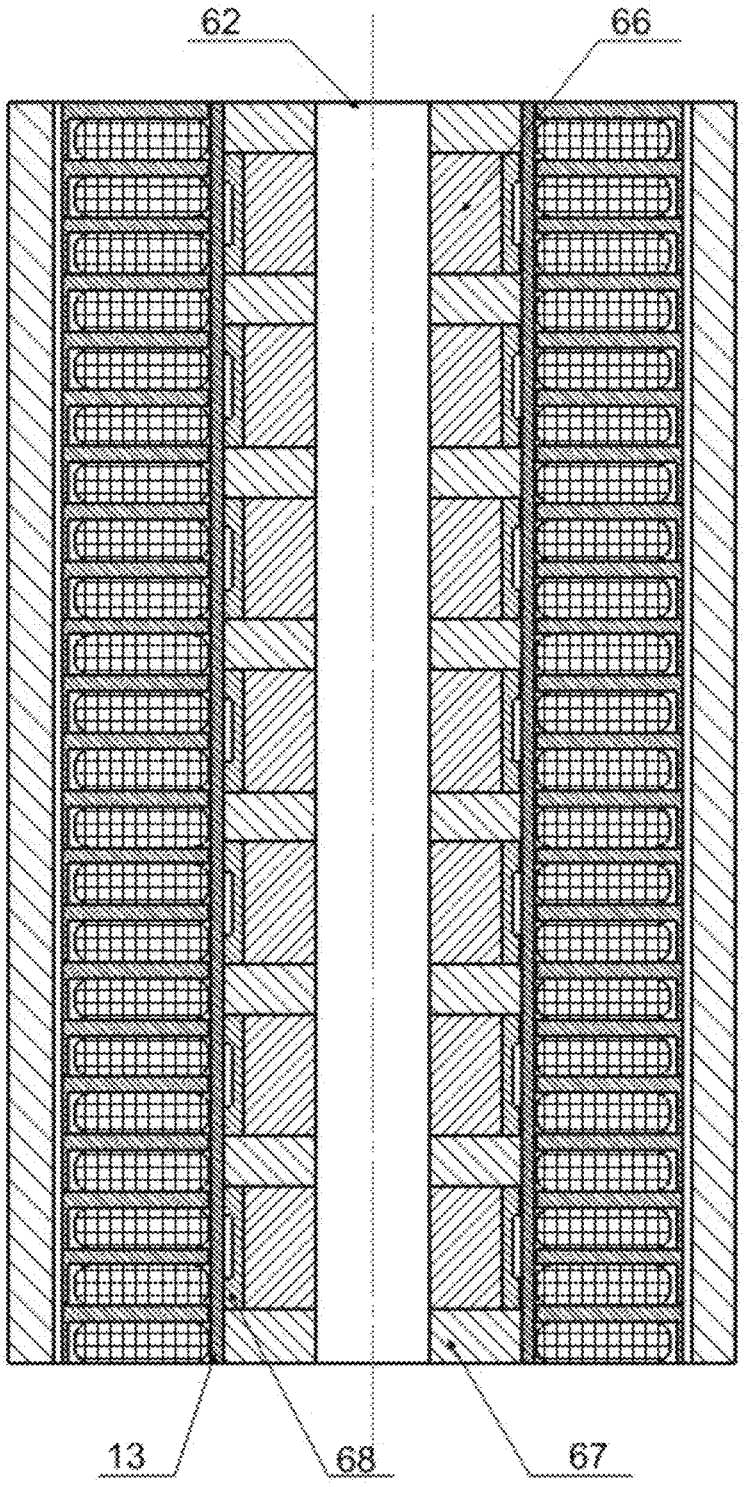
FIG. 14 shows design elements of the linear electrical motor module in section.

Drain ports 36, $\mathbf{36}_1$ of said first and second hydromechanical devices are spaced along the length of its cylindrical chamber 35, $\mathbf{35}_1$ and are designed to decelerate the stroke of piston 37, $\mathbf{37}_1$ as they alternately covered with the piston body and as increase in resistance to the working fluid flow occurs. Also, according to the preferred embodiment of the damping system, the hydromechanical device is installed in at least one of the end points of the movable part stroke of the linear submersible electric motor. The second damper 34 is configured to provide a communication of said movable part 62 (FIG. 13) with a plunger 70 of the pump unit module 10 by means of the connecting rod 69 installed in the piston cavity. Cavities of piston $\mathbf{37}_1$ and reciprocating support member $\mathbf{38}_1$ are interconnected and form a cavity, inside of which the connecting rod 69 of the movable part 62 of linear electric motor module 4 with pump unit plunger 70 is installed. An additional restraining force is provided by spring element 39, also serving as piston 37, $37_1$ return mechanism. Re-filling of cylindrical chamber 35, $35_1$ of the hydromechanical device takes place when the piston 37, $37_1$ is reciprocally moved through drain ports 36, $36_1$.

Also, according to the described embodiment of the invention, guide pipe 13 of the linear electric motor movable part 62 is installed inside of piston cavity 37. A relief of a liquid column located inside of guide pipe 13 installed in piston 37 cavity occurs through holes 40 at the bottom of the said guide pipe to the lowest end point as the movable part strokes downward, while piston 37 cavity gets narrow with respect to the diameter of guide pipe 13 and decelerates the stroke of the moving part 62 prior to contacting with said piston 37.

Figure 7:
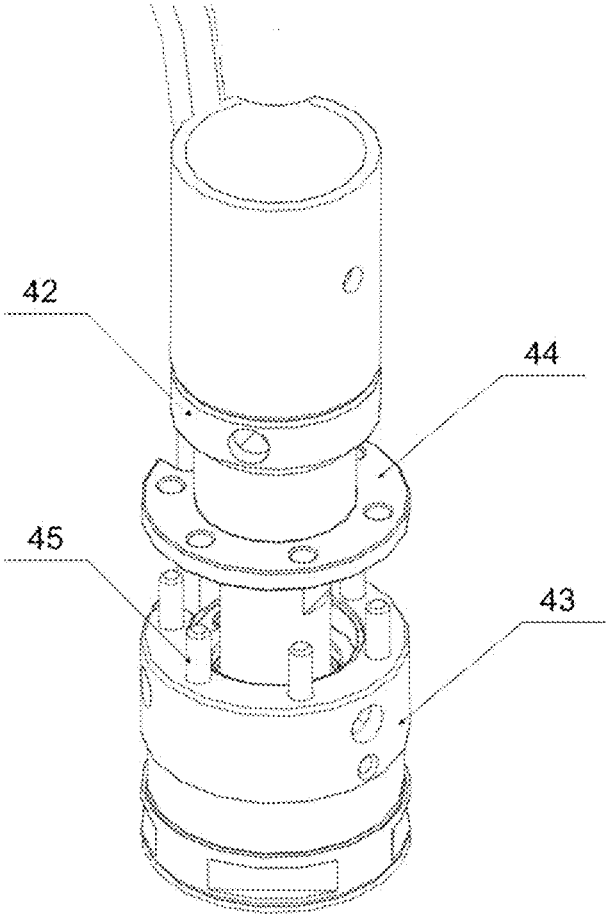
FIG. 7 shows the flange connection of the electrical submersible pump unit modules.
Figure 8:
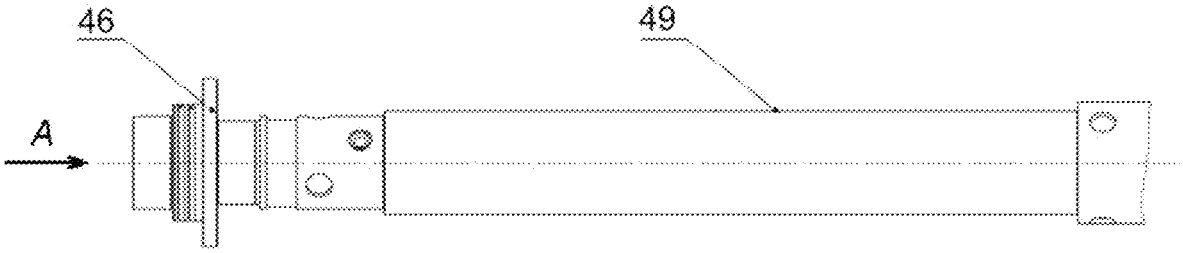
FIG. 8 shows the embodiment of the flange connection of the telemetry unit submersible module with the pump unit enclosure.
Figure 9:
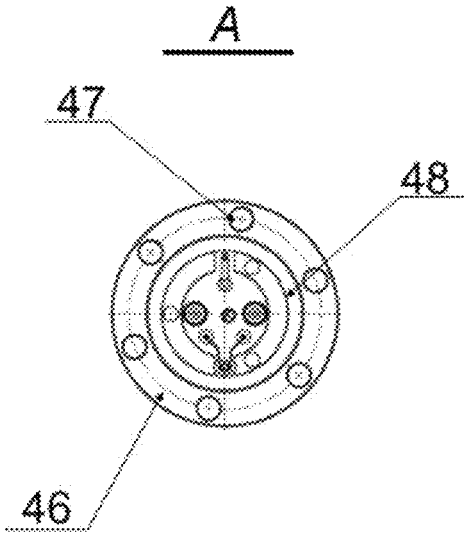
FIG. 9 shows View A of the flange connection of the telemetry unit submersible module.

The described modules of the linear electric submersible pump unit are connected with the detachable connection performed according to the flange connection approach (FIG. 7), consisting of joinable modules and thread bushes 42, 43 mounted at flanks. Providing that one of the bushes 42 comprises flange 44 and the second one 43 constitutes the counterpart with pre-installed studs 45. It should be also noted, that the telemetric system module is configured to be equipped with a set of replaceable flanges 46 (FIG. 8). Said replaceable flanges 46 have mounting holes 47 (FIG. 9), located depending on the diameter of the enclosure of the electric submersible pump unit. The diameter of mounting hole 48 of the flange is performed constant and corresponds to the diameter of telemetry system module 11 enclosure 49.

Figure 10:
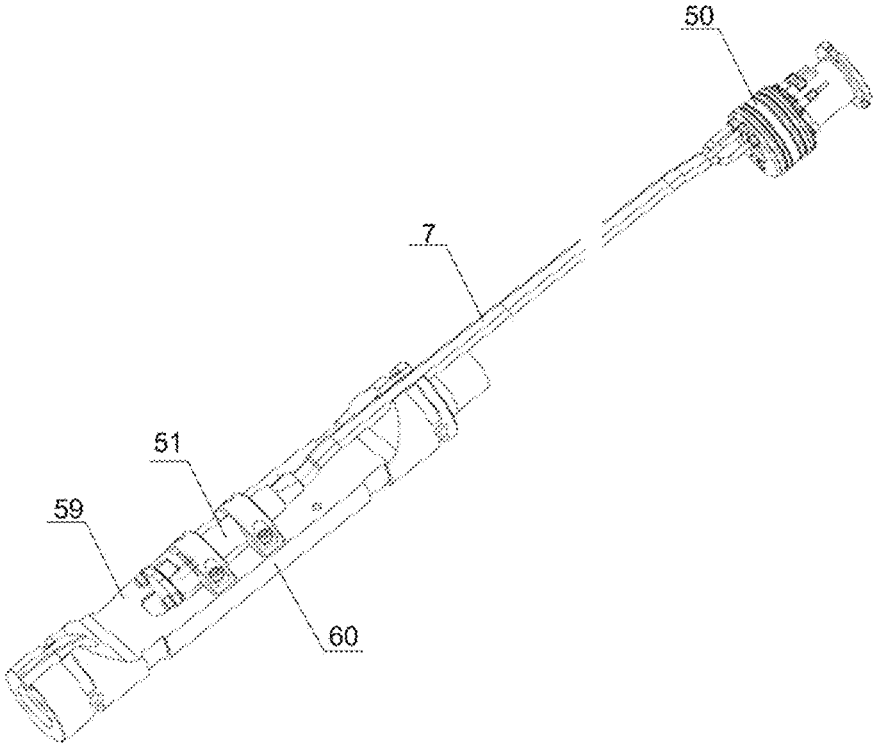
FIG. 10 shows the cable connection of the linear electrical submersible pump unit.
Figure 11:
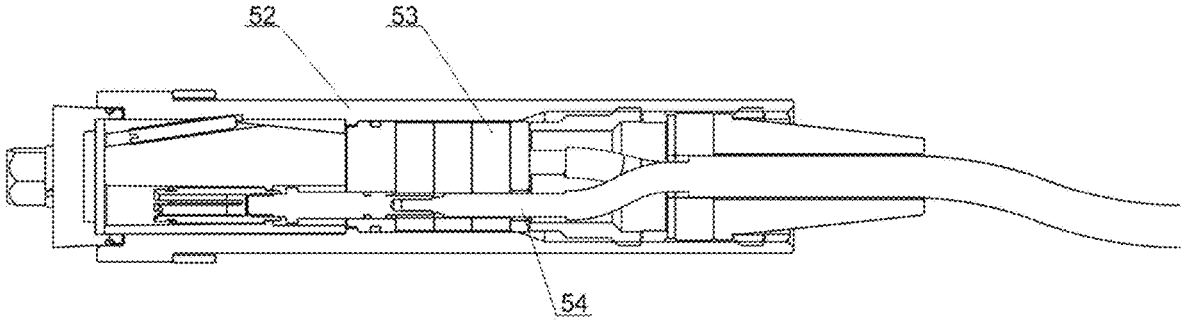
FIG. 11 shows the plug socket in section.
Figure 12:
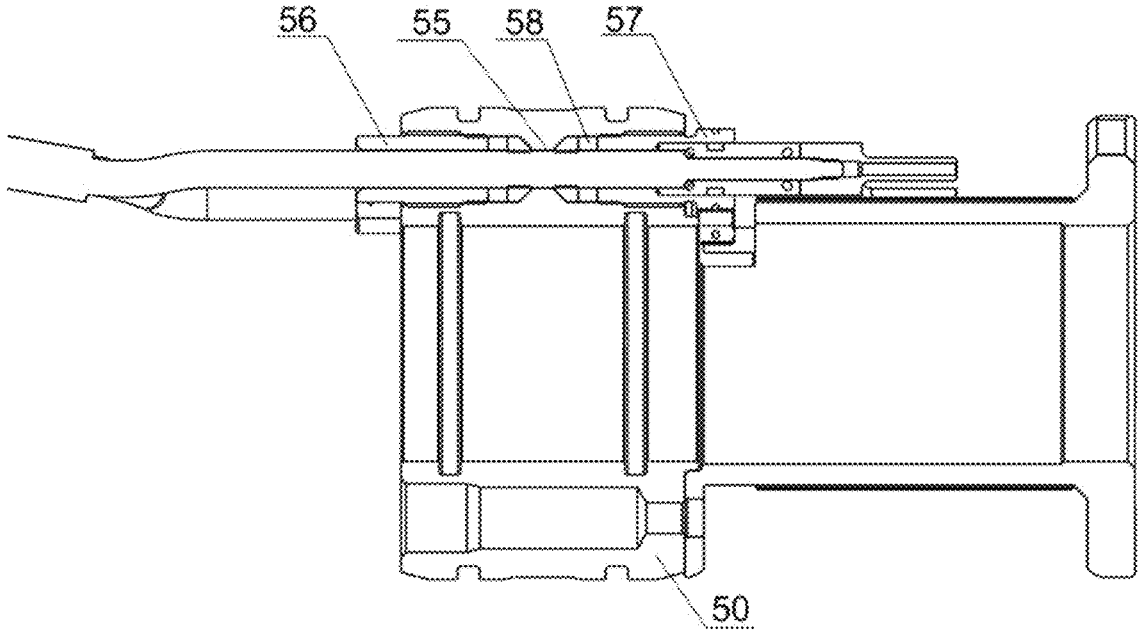
FIG. 12 shows the current lead end in section.

As previously mentioned, the connection of surface 1 and submergible 2 parts of the pump unit is provided by means of cable line 5 with plug connection 6. The plug and socket connection is performed within overall dimensions of the pump unit enclosure, determined by its largest cross section. The plug and socket connection (FIG. 10) comprises plug socket 51 (FIG. 11) arranged beyond input lead end 50 (as shown on FIG. 12 in details) of electrical motor module 4 on extended electrical conductor 7. The plug socket consists of hermetically sealed enclosure 52 with at least one electrical conductor 54 inserted inside and fixed by means of sealing polymer elements 53. The exposed end of the extended conductor 7 is mounted into current lead end 50 (FIG. 12) with the double side sealing performed by pressing crash element 55 with captive washers nuts 56, 57 with cushion sealing rings 58. Also, according to the mentioned embodiment, the hermetically sealed plug and socket connection is arranged within embedded surface 59 with respect to diminishing socket 60 (FIG. 10), installed between the pump unit module 10 output and oilwell tubing string input 61 (FIG. 1).

Movable part 62 (FIG. 13) of linear submersible electric motor module 4 is connected to plunger 70 of the pump unit module 10 by connecting link 63 consisting of the friction couple formed by hollow enclosure element 64 with movable rod 65 located inside. The movable rod 65 has a diameter equal to a diameter of movable part 62 of the linear submersible electric motor module 4. The longitudinal dimensions and the stroke length of movable rod 65 are selected so as to allow to provide at least partial positioning of movable part 62 of linear submersible electric motor module 4 within the cavity of enclosure element 64 of the friction couple. The described friction couple is performed by providing a sufficiently necessary processing accuracy of contact surfaces. This allows to form a labyrinth sealing area and to provide the alignment of the movable part 62 of the electric motor module 4 with compensation of radial loads, as well as protection against a breakthrough of mechanical impurities into the cavity of the guide pipe of the movable part.

According to the described embodiment of the invention movable part 62 (FIG. 13) of linear submersible electric motor 4 consists of the plurality of permanent magnets 66 separated by the ferromagnetic inserts, namely magnetic field concentrators 67. Copper alloy plugs 68 are installed over the permanent magnets 66 between the magnetic field concentrators 67. Also, plugs 68 can be made of a polymeric material as an alternative. These plugs provide a permanent magnets protection against mechanical damage, as well as the decrease in the friction ratio by means of transferring the part of the material onto the inner surface of guide pipe 13, as they wear out. Simultaneously the guide pipe forms the friction couple with moving part 62 of linear submersible electric motor module 4 with the reduced friction ratio. Also, according to the suggested embodiment, the hardness of guide pipe 13 is higher than the hardness of ferromagnetic inserts 67 and copper alloy plugs 68. Said guide pipe 13 is made of a non-magnetic material and its required hardness is achieved by means of the surface hardening.

The embodiment of the claimed invention contributes to achievement of the mentioned technical result by providing unification of the design with simultaneous increase in the manufacturing processability by means of involving easily removable interoperable modules for its manufacture. Also the described embodiment of the cable plug and socket connection and the hydraulic damper module contributes to decrease in the pump unit dimensions.

According to the claimed invention the telemetry system performance provides an increase in a level of protection from a high-voltage interference by installing filtering devices in the surface and submergible units, moreover, implementation of the described technical solution enables increase in the reliability of operation by providing protection against high voltage and instrumentation of the hardware-software mode of the surface control unit for checking the insulation.

Providing that the arrangement of the described damping system, integrated into the submersible pumping unit construction without any significant increase in its overall dimensions, and the execution of the movable part of the linear drive with elements, reducing the friction ratio, provide a reduction in dynamic loads on the elements of the electrical motor design and contribute to increase in its operating resource.

What is claimed is:

1. A linear electric submersible pump unit, comprising:

a surface part, a telemetry system, and a submersible part; wherein said submersible part comprises a set of separately enclosed modules connected to one another, said separately enclosed modules forming a single oil-filled system;

wherein said set of separately enclosed modules comprises: a linear submersible electric motor module, a pump unit module, a hydraulic compensator module comprising a first damper, a second damper installed between said linear submersible electric motor module and said pump unit module, and a submersible module that is in communication with the telemetry system; wherein the linear submersible electric motor module comprises a stator cavity and a movable part;

wherein the pump unit module comprises integrated filters, a gravity gas separation zone, a plunger with a connecting rod and a connecting link, wherein the submersible module that is in communication with the telemetry system comprises a set of sensors for measuring well parameters and motor parameters, wherein the submersible module that is in communication with the telemetry system is connected to the surface part via a zero point of wye-connected linear motor windings, wherein the surface part comprises a control unit with a three-phase high-frequency regulating inverter connected to the linear submersible electric motor module through an output transformer via an insulated three-wire cable;

wherein said set of separately enclosed modules are connected to each other by means of a detachable connection;

wherein the hydraulic compensator module is connected to the linear submersible electric motor module, wherein the hydraulic compensator module comprises an elastic diaphragm with a connecting channel, wherein an internal cavity of the elastic diaphragm is in fluid connection with the stator cavity via the connecting channel, wherein the connecting channel is a part of the single oil-filled system, wherein the first damper comprises a first hydromechanical device, and wherein the second damper comprises one or more second hydromechanical devices.

2. The linear electric submersible pump unit of claim 1, wherein the detachable connection comprises a flange connection approach, said flange connection approach comprising connectable thread bushes, wherein a first one of said thread bushes comprises a flange, and a second one of said thread bushes comprises a counterpart with pre-installed studs, wherein the submersible module that is in communication with the telemetry system is equipped with a set of replaceable flanges with mounting holes, located depending on a diameter of an enclosure of the linear submersible electric motor module, wherein a diameter of each mounting hole of each said flange is constant and corresponds to a diameter of an enclosure of said submersible module that is in communication with the telemetry system.

3. The linear electric submersible pump unit of claim 1, wherein the telemetry system comprises a low frequency filter with a switching element of a control system of the surface part, wherein said low frequency filter is mounted on a line of communication with a secondary winding of the output transformer and is configured to protect the telemetry system from a high voltage influence, wherein the surface part contains a switching device configured to reverse a polarity of a voltage, in order to measure an insulation resistance.

4. The linear electric submersible pump unit of claim 1, wherein the elastic diaphragm of the hydraulic compensator module is hermetically fixed at attachment points via a composite clamp, and wherein said elastic diaphragm is protected from mechanical damage via a non-metallic plug.

5. The linear electric submersible pump unit according to claim 1, wherein the elastic diaphragm of the hydraulic compensator module is placed eccentrically relative to a symmetry axis of the submersible part of the linear electric submersible pump unit.

6. The linear electric submersible pump unit of claim 1, wherein the surface part and the submersible part are connected by a cable line with a plug connection, wherein the plug connection is performed within overall dimensions of the submersible part of the pump unit module, as determined by a largest cross section of the submersible part of the pump unit module, wherein the plug connection comprises a socket arranged on an extended electrical conductor, wherein the socket comprises a sealed enclosure with at least one electrical conductor inserted into said sealed enclosure and fixed via sealing polymer elements, wherein an exposed end of the extended electrical conductor is mounted into a current lead end of the linear submersible electric motor with a double side sealing.

7. The linear electric submersible pump unit of claim 6, wherein the plug connection is installed on an embedded surface of a diminishing socket, said diminishing socket being installed between an output of the pump unit module and an oil-well tubing input.

8. A linear electric submersible pump unit, comprising:

a surface part, a telemetry system, and a submersible part;

said submersible part comprising a set of separately enclosed modules connected to each other, said set of separately enclosed modules forming a single oil-filled system; said set of separately enclosed modules comprising: a linear submersible electric motor module, a pump unit module, a hydraulic compensator module comprising a first damper, a second damper installed between said linear submersible electric motor module and said pump unit module, and a submersible module that is in communication with the telemetry system; said linear submersible electric motor module comprising a stator cavity and a movable part;

said pump unit module comprising integrated filters, a gravity gas separation zone, and a plunger with a connecting rod and a connecting link;

wherein said first and second damper comprises one or more hydromechanical dynamic load compensating devices, wherein said one or more hydromechanical dynamic load compensating devices are installed in at least one end point of the movable part of the linear submersible electric motor module, each of said one or more hydromechanical dynamic load compensating devices comprising a cylindrical chamber with drain ports, a movable piston, and a reciprocating support member with a spring element, said cylindrical chamber being filled with a working fluid.

9. The linear electric submersible pump unit of claim 8, wherein said drain ports are spaced along a length of the cylindrical chamber, and wherein said drain ports are alternately covered with a movable piston body.

10. The linear electric submersible pump unit of claim 8, wherein one of said first or second dampers is installed in at least one of the end points of the movable part of the linear submersible electric motor module, wherein the movable part is connected to a plunger of the pump unit module via the connecting rod.

11. A linear electric submersible pump unit, comprising:

a surface part, a telemetry system, and a submersible part; said submersible part comprising a set of separately enclosed modules connected to each other and forming a single oil-filled system;

said set of separately enclosed modules comprising: a linear submersible electric motor module, a pump unit module, a hydraulic compensator module comprising a first damper, a second damper installed between said linear submersible electric motor module and said pump unit module, and a submersible module that is in communication with the telemetry system; said linear submersible electric motor module comprising a stator cavity and a movable part;

said pump unit module comprising integrated filters, a gravity gas separation zone, and a plunger with a connecting rod and a connecting link;

wherein said movable part of the linear submersible electric motor module is connected to the plunger of the pump unit module via said connecting link, said connecting link comprising a friction couple, said friction couple comprising a hollow enclosure element with a movable rod located inside said hollow enclosure element, said movable rod having a diameter equal to a diameter of the movable part of the linear submersible electric motor module, wherein the movable part of the linear submersible electric motor module is at least partially positioned within the hollow enclosure element cavity of the friction couple.

12. The linear electric submersible pump unit of claim 11, wherein the movable part of the linear submersible electric motor module is arranged within a guide pipe;

wherein the movable part comprises a plurality of permanent magnetic field concentrators, wherein, between each of one of said plurality of permanent magnetic field concentrators, copper alloy plugs are installed such that each one of said permanent magnetic field concentrators is covered by one or more of said copper alloy plugs.

13. The linear electric submersible pump unit of claim 12, wherein the guide pipe forms a second friction couple with the movable part of the linear submersible electric motor module, wherein a hardness of the guide pipe is higher than a hardness of the magnetic field concentrator and/or the copper alloy plugs.

14. The linear electric submersible pump unit of claim 12, wherein the guide pipe is made of a non-magnetic material, wherein a required hardness of the guide pipe is achieved via a surface hardening.

* * * * *